US009946209B2

(12) United States Patent
Watanabe

(10) Patent No.: US 9,946,209 B2
(45) Date of Patent: Apr. 17, 2018

(54) IMAGE FORMING APPARATUS

(71) Applicant: KYOCERA Document Solutions Inc., Osaka (JP)

(72) Inventor: Masaru Watanabe, Osaka (JP)

(73) Assignee: Kyocera Document Solutions, Inc. (JP)

( * ) Notice: Subject to any disclaimer, the term of this patent is extended or adjusted under 35 U.S.C. 154(b) by 0 days.

(21) Appl. No.: 15/636,606

(22) Filed: Jun. 28, 2017

(65) Prior Publication Data

US 2018/0004142 A1 Jan. 4, 2018

(30) Foreign Application Priority Data

Jul. 1, 2016 (JP) ..... 2016-132100

(51) Int. Cl.
*G03G 15/00* (2006.01)

(52) U.S. Cl.
CPC ..... *G03G 15/556* (2013.01); *G03G 15/5041* (2013.01)

(58) Field of Classification Search
CPC ..... G03G 15/5041; G03G 15/556
See application file for complete search history.

(56) References Cited

U.S. PATENT DOCUMENTS

| | | | | |
|---|---|---|---|---|
| 7,764,897 | B2 * | 7/2010 | Takezawa | G03G 15/0194 399/301 |
| 9,141,059 | B2 * | 9/2015 | Muto | G03G 15/5058 |
| 9,389,564 | B2 * | 7/2016 | Sekiguchi | G03G 15/0189 |
| 2006/0204267 | A1 | 9/2006 | Watanabe | |

FOREIGN PATENT DOCUMENTS

| | | |
|---|---|---|
| JP | 2005-148299 | 6/2005 |
| JP | 2006-201521 | 8/2006 |

* cited by examiner

*Primary Examiner* — Gregory H Curran

(57) ABSTRACT

A density correction unit (a1) obtains density measurement values of a surface in a measurement section of an image carrier at a first round, (a2) calculates as section background data at the first round respective differences between the density measurement values at the first round and an average value thereof, (a3) obtains density measurement values of a surface at least in the measurement section at a second round, (a4) calculates as section background data at the second round respective differences between the density measurement values at the second round and an average value thereof in a specific section with the same length as the measurement section, and (a5) determines the rotation period on the basis of a correlation between the section background data at the first round and at the second round. Here the measurement section is a part in a circulating direction of the image carrier.

6 Claims, 8 Drawing Sheets

FIG. 6

$$R1(j) = \sum_{i=-N/2}^{N/2} Diff1(i) \cdot Diff2(i+j), j = -Jmax, \cdots, +Jmax$$

$$R2(j) = \sum_{i=-N/2}^{N/2} \left(Diff1(i) - Diff2(i+j)\right)^2, j = -Jmax, \cdots, +Jmax$$

IMAGE FORMING APPARATUS

CROSS-REFERENCE TO RELATED APPLICATIONS

This application relates to and claims priority rights from Japanese Patent Application No. 2016-132100, filed on Jul. 1, 2016, the entire disclosures of which are hereby incorporated by reference herein.

BACKGROUND

1. Field of the Present Disclosure

The present disclosure relates to an image forming apparatus.

2. Description of the Related Art

In general, an image forming apparatus using an electrographic process forms a patch image (i.e. reference image) by transferring toner to an intermediate transfer belt for image stability, detects the toner part using a sensor, and calculates a value corresponding to a toner amount (i.e. a toner density) from an output value of the sensor. This image forming apparatus resets a process condition for printing on the basis of this result and thereby controls to achieve a proper toner density.

For stably controlling the toner density, it is important to correctly detect a value corresponding to the toner density, and an image forming apparatus calculates a coverage factor corresponding to the toner amount in accordance with the following formula.

$$\text{Coverage factor}=1-((P-Po)-(S-So)*K)/((Pg-Po)-(Sg-So)*K)$$

Here P is a P polarized light measurement value when detecting a toner pattern, S is an S polarized light measurement value when detecting the toner pattern, Po is a dark potential of P polarized light, So is a dark potential of S polarized light, Pg is a P polarized light measurement value when detecting a belt surface, Sg is an S polarized light measurement value when detecting the belt surface, and K is a constant.

For example, before forming the toner pattern, a reflectance (a reflection light intensity) of the intermediate transfer belt or the like is measured as a background and stored as background data; and a reflectance (a reflection light intensity) is measured of each toner patch in the toner pattern, the background data is read of a position where each toner patch in the toner pattern was formed, and a toner density measurement value such as a coverage factor is calculated as mentioned and thereby determined.

Therefore, it is required to correctly measure a density of the belt surface (i.e. Pg and Sg) at a position where the toner pattern is formed.

For example, there is a method that (a) the background data of an image carrier such as an intermediate transfer belt is measured in advance before calibration, and (b1) a time required for the image carrier to rotate by one round (a rotation period) is calculated on the basis of a belt round length, (b2) a rotational speed (a linear velocity) and the like, and (b3) the background data is determined and read corresponding to a position where each toner patch in the toner pattern is formed.

However, due to dispersion of a belt round length of the belt itself, expansion and/or contraction of the belt round length due to environment, fluctuation of the rotational speed (linear velocity) and the like, in some cases, the background data corresponding to a correct position is not read, and consequently the density measurement value is not correctly determined.

Therefore, an image forming apparatus determines a relative position of background data sequence corresponding to toner pattern density data sequence, and correctly determines the section background data corresponding to the toner pattern density measurement data on the basis of the determined position.

However, when determining the background data detected on the basis of a position of an image carrier where a patch in the toner pattern was formed, it is required to cause the image carrier such as intermediate transfer belt to rotate by at least two rounds and determine a belt rotation period (i.e. a time required to rotate by one rotation of the belt).

Specifically, in the image carrier that has periodicity, background measurement values in the first round and in the second round are determined round by round and subsequently a relative position is determined to cause a correlation between them to be high and therefore at least two rounds of the image carrier are required to determine the belt period.

Consequently it takes a long time for the calibration.

It is supposed that in order to reduce a measurement time of the belt period, only for a part of the belt in its circulating direction, background measurement values in the first round and background measurement values in the second round are determined and a relative position is determined to cause a correlation between them to be high, but in such a case, variation of a detection condition occurs between the first round and the second round, such as (a) fluctuation of a distance between a belt surface and a sensor due to eccentricity of facing rollers or (b) fluctuation of an incidence angle of measurement light due to wobbling of a belt surface, and consequently the correlation may not get high between the background measurement values in the first round and the background measurement values in the second round.

It should be noted that if a phase mark is arranged at a predetermined position on an image carrier, a phase sensor reads the phase mark and thereby position information of the phase mark is obtained, then a rotation period of the image carrier can be derived on the basis of an interval of detection timings of the position information of the phase mark; but in such a case, the phase mark, the phase sensor and the like increase a cost of the apparatus and therefore it is not favorable.

SUMMARY

An image forming apparatus according to an aspect of the present disclosure includes an image carrier, a density sensor, and a density correction unit. The density sensor is configured to detect a density measurement value of a toner pattern on the image carrier and a density measurement value of a surface of the image carrier. The density correction unit is configured to (a) perform a measurement process that measures a rotation period of the image carrier, and (b) determine a density measurement value of a surface of the image carrier at a forming position of the toner pattern on the basis of the rotation period, determine a density of the toner pattern on the basis of the density measurement value of the toner pattern and the determined density measurement value of the surface of the image carrier and perform correction of a density characteristic on the basis of the determined density of the toner pattern. In the measurement process, the density correction unit (a1) obtains density measurement values of a surface in a measurement section of the image carrier at a first round, (a2) calculates as section background data at the first round respective differences between the density measurement values at the first round and an average value of the density measurement values at the first round, (a3) obtains density measurement values of a surface at least in the measurement section of the image carrier at a second round, (a4) calculates as section background data at the second round respective differences between the density measurement values at the second round and an average value of the density measurement values at the second round in a specific section of which a length is identical to a length of the measurement section, and (a5) determines the rotation period on the basis of a correlation between the section background data at the first round and the section background data at the second round; and the measurement section is a part in a circulating direction of the image carrier.

These and other objects, features and advantages of the present disclosure will become more apparent upon reading of the following detailed description along with the accompanied drawings.

BRIEF DESCRIPTION OF THE DRAWINGS

FIG. 6 shows a diagram that indicates calculation formulas of a cross-correlation function R1(*j*) and a correlation index R2(*j*);

DETAILED DESCRIPTION

Hereinafter, an embodiment according to an aspect of the present disclosure will be explained with reference to drawings.

Figure 1:
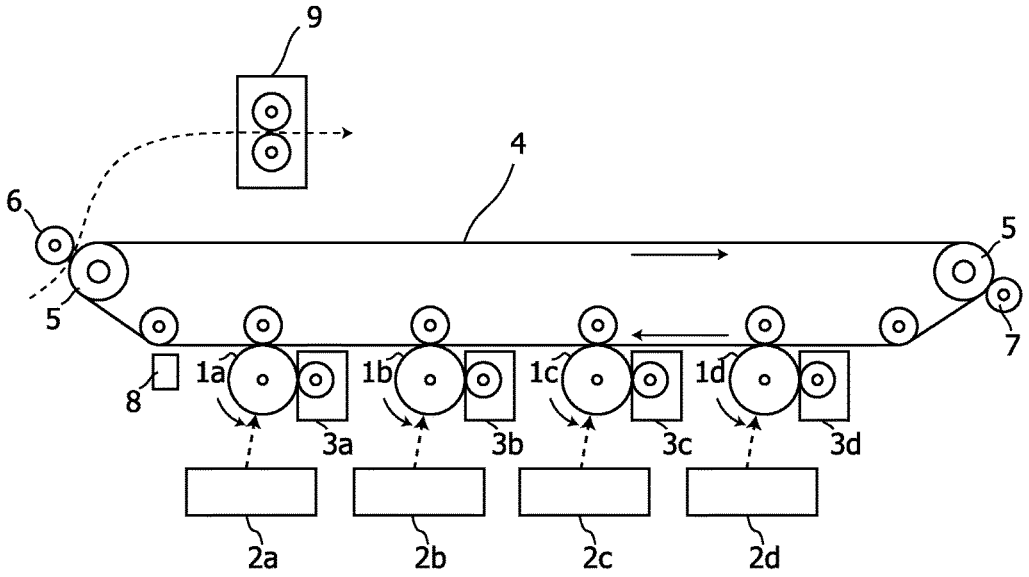
FIG. 1 shows a side view that indicates an internal mechanical configuration of an image forming apparatus in an embodiment according to the present disclosure.

FIG. 1 shows a side view that indicates an internal mechanical configuration of an image forming apparatus in an embodiment according to the present disclosure. The image forming apparatus shown in FIG. 1 is an apparatus including an electrographic-type printing function such as a printer, a facsimile machine, a copier, or a multi function peripheral.

The image forming apparatus in the present embodiment includes a tandem-type color development device. This color development device includes photoconductor drums 1*a* to 1*d*, exposure devices 2*a* to 2*d*, and development units 3*a* to 3*d*. The photoconductor drums 1*a* to 1*d* are photoconductors of four colors: Cyan, Magenta, Yellow and Black. The exposure devices 2*a* to 2*d* are devices that form electrostatic latent images by irradiating the photoconductor drums 1*a* to 1*d* with laser light. Each of the exposure devices 2*a* to 2*d* includes a laser diode as a light emitter of the laser light, optical elements (such as lens, mirror and polygon mirror) that guide the laser light to the photoconductor drum 1*a*, 1*b*, 1*c*, or 1*d*.

Further, in the periphery of each one of the photo conductor drums 1*a* to 1*d*, a charging unit such as scorotron, a cleaning device, a static electricity eliminator and the like are disposed. The cleaning device removes residual toner on each one of the photo conductor drums 1*a* to 1*d* after primary transfer. The static electricity eliminator eliminates static electricity of each one of the photo conductor drums 1*a* to 1*d* after primary transfer.

Toner containers which contain toner of four colors: Cyan, Magenta, Yellow and Black are attached to the development units 3*a* to 3*d*, respectively. In the development units 3*a* to 3*d*, the toner is supplied from the toner containers and this toner and carrier compose developer. An external additive such as titanium oxide is attached to the toner. The development units 3*a* to 3*d* form toner images by attaching the toner to electrostatic latent images on the photoconductor drums 1*a* to 1*d*.

The photoconductor drum 1*a*, the exposure device 2*a* and the development unit 3*a* perform development of Black. The photoconductor drum 1*b*, the exposure device 2*b* and the development unit 3*b* perform development of Magenta. The photoconductor drum 1*c*, the exposure device 2*c* and the development unit 3*c* perform development of Cyan. The photoconductor drum 1*d*, the exposure device 2*d* and the development unit 3*d* perform development of Yellow.

The intermediate transfer belt 4 is a loop-shaped image carrier, and contacts the photoconductor drums 1*a* to 1*d*. Toner images on the photoconductor drums 1*a* to 1*d* are primarily transferred onto the intermediate transfer belt 4. The intermediate transfer belt 4 is an intermediate transfer member. The intermediate transfer belt 4 is hitched around driving rollers 5, and rotates by driving force of the driving rollers 5 towards the direction from the contact position with the photoconductor drum 1*d* to the contact position with the photoconductor drum 1*a*.

A transfer roller 6 causes a conveyed paper sheet to contact the transfer belt 4, and secondarily transfers the toner image on the transfer belt 4 to the paper sheet. The paper sheet on which the toner image has been transferred is conveyed to a fuser 9, and consequently, the toner image is fixed on the paper sheet.

A roller 7 has a cleaning brush, and removes residual toner on the intermediate transfer belt 4 by contacting the cleaning brush to the intermediate transfer belt 4 after transferring the toner image to the paper sheet. In density adjustment, the roller 7 also removes external additives with toner carried on an area where the external additives adheres on the intermediate transfer belt 4.

A sensor 8 detects a density of toner on the intermediate transfer belt 4. The sensor 8 is a reflection-light type density sensor and irradiates the intermediate transfer belt 4 with measurement light and detects its reflection light. When performing calibration (density adjustment) of a density and a gradation, the sensor 8 irradiates a predetermined area of the intermediate transfer belt 4 with measurement light, detects its reflection light and outputs an electric signal corresponding to an intensity of the detected light and thereby detects density measurement values of a toner pattern for adjustment of the intermediate transfer belt 4 and density measurement values of a surface of the intermediate transfer belt 4.

Figure 2:
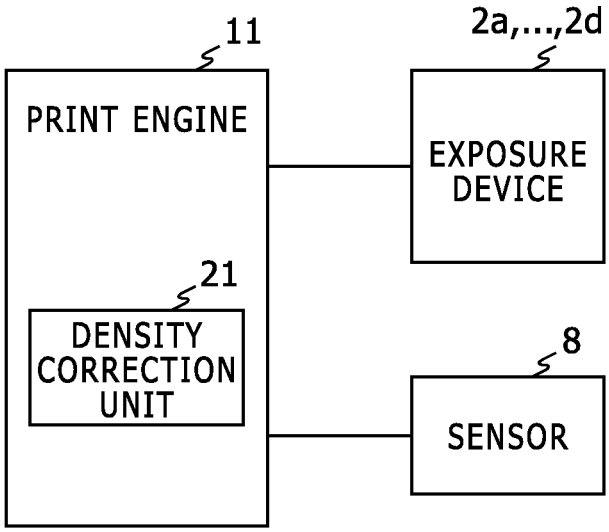
FIG. 2 shows a block diagram that indicates a part of an electronic configuration of the image forming apparatus shown in FIG. 1.

FIG. 2 shows a block diagram that indicates a part of an electronic configuration of the image forming apparatus shown in FIG. 1. In FIG. 2, a print engine 11 is a processing circuit that controls a driving source which drives the aforementioned rollers, a bias induction circuit which induces developing biases and primary transfer biases, and the exposure devices 2*a* to 2*d* in order to feed a paper sheet, print an image on the paper sheet, and output the paper sheet. The development biases are applied between the photoconductor drums 1*a* to 1*d* and the development units 3*a* to 3*d*, respectively. The primary transfer biases are applied between the photoconductor drums 1*a* to 1*d* and the intermediate transfer belt 4, respectively. The print engine includes an ASIC (Application Specific Integrated Circuit), a computer that executes a control program, and/or the like and acts as sorts of processing units.

Figure 3:
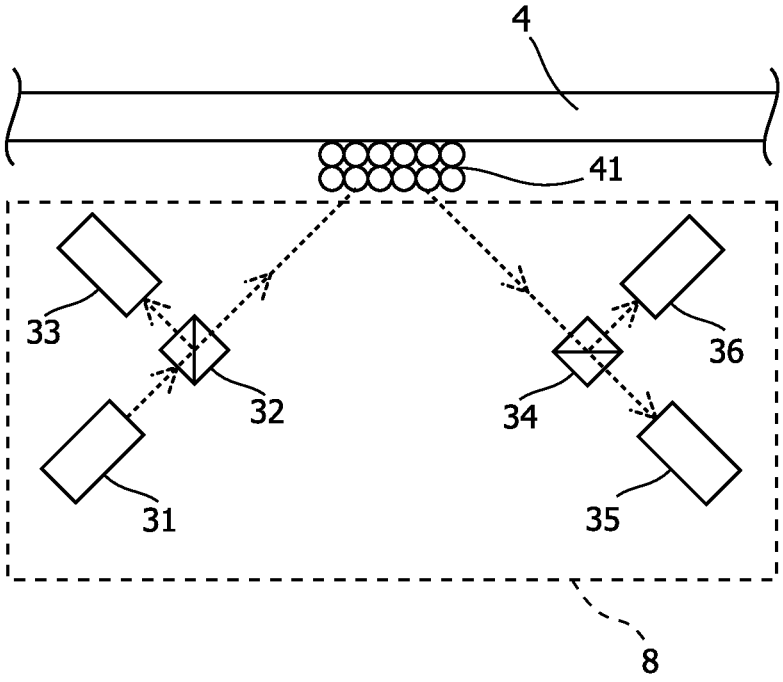
FIG. 3 shows a diagram that indicates an example of a configuration of a sensor 8 shown in FIG. 1.

FIG. 3 shows a diagram that indicates an example of a configuration of the sensor 8 shown in FIG. 1. A configuration of the sensor 8 is not limited to the configuration shown in FIG. 3, and for example, may be a type that separately detects specular reflection light and diffuse reflection light in the refection light.

As shown in FIG. 3, the sensor 8 includes a light source 31 which emits a light beam, a beam splitter 32 on the light emitting side, a light receiving element 33 on the light emitting side, a beam splitter 34 on the light receiving side, a first light receiving element 35, and a second light receiving element 36.

For example, the light source 31 is a light emitting diode. The beam splitter 32 transmits a P-polarized light component and reflects an S-polarized light component in a light beam from the light source 31. The light receiving element 33 on the light emitting side is, for example, a photo diode, and detects the S-polarized component from the beam splitter 32, and outputs an electrical signal corresponding to the detected intensity of the S-polarized component. This electrical signal is used for stabilizing control of the light source 31. The P-polarized component light transmitted through the beam splitter 32 on the light emitter side is incident to a surface (i.e. either a toner image 41 or the surface material) of the intermediate transfer belt 4 and reflects. This reflection light contains a specular reflection component and a diffuse reflection component. The specular reflection component is P-polarized light. The beam splitter 34 transmits a P-polarized light component (i.e. a specular reflection component) in the reflection light and reflects an S-polarized light component in the reflection light. The first light receiving element is, for example, a photo diode, and detects the P-polarized light component (i.e. specular reflection component) transmitted through the beam splitter 34, and outputs an electrical signal corresponding to the detected intensity of the P-polarized light component. The second light receiving element 36 is, for example, a photo diode, has the same light detecting characteristic as the first light receiving element 35, and detects the S-polarized light component (i.e. diffuse reflection component) transmitted through the beam splitter 34, and outputs an electrical signal corresponding to the detected intensity of the S-polarized light component.

In this embodiment, the print engine 11 acts as a density correction unit 21 that performs calibration of a density and a gradation. The density correction unit 21 (a) causes to develop an adjustment toner pattern on the photoconductor drum 1*a*, 1*b*, 1*c* or 1*d* and transfer the adjustment toner pattern to the intermediate transfer belt 4, (b) determines the aforementioned coverage factor for example, as a toner density of the adjustment toner pattern on the basis of: (b1) an output value of the sensor 8 corresponding to the measurement light received from a predetermined measurement area before the adjustment toner pattern is carried on the measurement area and (b2) an output value of the sensor 8 corresponding to the measurement light received from the measurement area on which the adjustment toner pattern is carried, and (c) performs density correction on the basis of the determined toner density. The adjustment toner pattern on the intermediate transfer belt 4 is removed by a cleaning brush of the roller 7 after the density measurement.

Specifically, the density correction unit 21 (a) performs a measurement process that measures a rotation period of the intermediate transfer belt 4, and (b) determines a density measurement value of a surface of the intermediate transfer belt 4 at a forming position of the toner pattern on the basis of the rotation period, determines a density of the toner pattern on the basis of the density measurement value of the toner pattern and the determined density measurement value of the surface of the intermediate transfer belt 4, and performs correction of a density characteristic on the basis of the determined density of the toner pattern.

In the measurement process of the rotation period, the density correction unit 21 (a1) obtains density measurement values of a surface in a measurement section of the intermediate transfer belt 4 at the first round, (a2) calculates as section background data at the first round respective differences Diff1(*i*) between the density measurement values D1(*i*) at the first round and an average value D1*av* of the density measurement values D1(*i*) at the first round, (a3) obtains density measurement values D2(*i*) of a surface at least in the measurement section of the image carrier at the second round, (a4) calculates as section background data at the second round respective differences Diff2(*i*) between the density measurement values D2(*i*) at the second round and an average value D2*av* of the density measurement values D2(*i*) at the second round in a specific section of which a length is identical to a length of the measurement section, and (a5) determines the rotation period on the basis of a correlation between the section background data at the first round and the section background data at the second round. Here the measurement section is a part in a circulating direction of the intermediate transfer belt 4.

It should be noted that a density measurement value of a surface of the intermediate transfer belt 4 in this measurement process may be a measurement value of the P-polarized light component (or the specular reflection light component) or may be a difference between a measurement value of the P-polarized light component (or the specular reflection light component) and a measurement value of the S-polarized light component (or the diffuse reflection light component).

Figure 4:
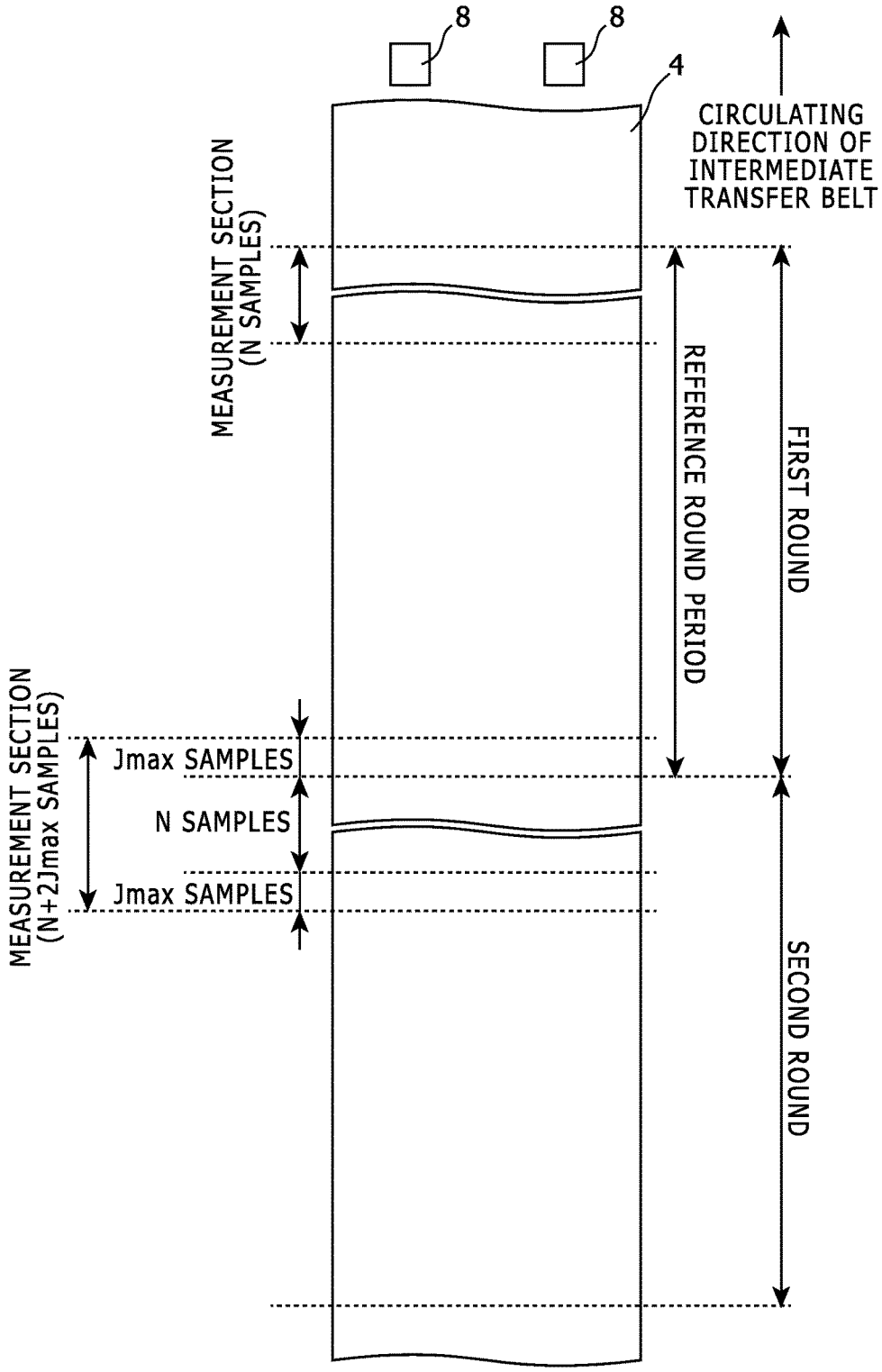
FIG. 4 shows a diagram that explains a measurement position (i.e. a sampling position) of a surface density fluctuation of an intermediate transfer belt 4 in the image forming apparatus shown in FIGS. 1 and 2.

FIG. 4 shows a diagram that explains a measurement position (i.e. a sampling position) of a surface density fluctuation of the intermediate transfer belt 4 in the image forming apparatus shown in FIGS. 1 and 2.

In this embodiment, as shown in FIG. 4, the density correction unit 21 performs sampling predetermined N times with a predetermined sampling interval t (a time interval) in the measurement section at the first round of the intermediate transfer belt 4, and obtains as N samples "section background data" at the first round that includes N differences Diff1(*i*).

Further, in this embodiment, as shown in FIG. 4, at the second round subsequent to the first round of the intermediate transfer belt 4, the density correction unit 21 performs sampling predetermined (N+2Jmax) times with a predetermined sampling interval t (a time interval) in an extended section that includes the measurement section, and obtains section background data at the second round that includes N differences Diff2(*i*) as N samples in a specific section selected among the (N+2*Jmax) samples.

For example, when the number of the sampling times corresponding to a reference rotation period is 3000, it is set that N=300 and Jmax=13 or the like.

As shown in FIG. 4, the extended section starts at a time point STPe early by a product of Jmax and the sampling interval t from a time point TP late by a belt reference rotation period BRRP from a starting time point STP of the measurement section at the first round (STPe=STP+BRRP−Jmax*t), and here the belt reference rotation period BRRP is obtained by dividing the belt reference round length L by a linear velocity V of the belt (BRRP=L/V).

Jmax is set so that (Jmax*V*t) exceeds an uppermost value of a round length fluctuation from a reference round length. For example, the uppermost value of the round length fluctuation is determined in advance in an experiment or the like.

Specifically, the density correction unit 21 obtains density measurement values D2(*i*) of a surface of the intermediate transfer belt 4 at the second round in an extended section obtained by extending the aforementioned measurement section by a predetermined length (a length corresponding to double of the number of the sampling Jmax), and calculates as the section background data at the second round respective differences Diff2(*i*) between the density measurement values D2(*i*) in the aforementioned specific section within the extended section at the second round and an average value D2*av* of the density measurement values D2(*i*) in the specific section within the extended section at the second round.

Therefore, the section background data at the first round includes a sequence of the N differences corresponding to the N density measurement values measured along a time series in the aforementioned measurement section, and the section background data at the second round includes a sequence of the N differences corresponding to N density measurement values among N2 density measurement values measured along a time series in the aforementioned extended section (N2=N+2*Jmax).

Figure 5:
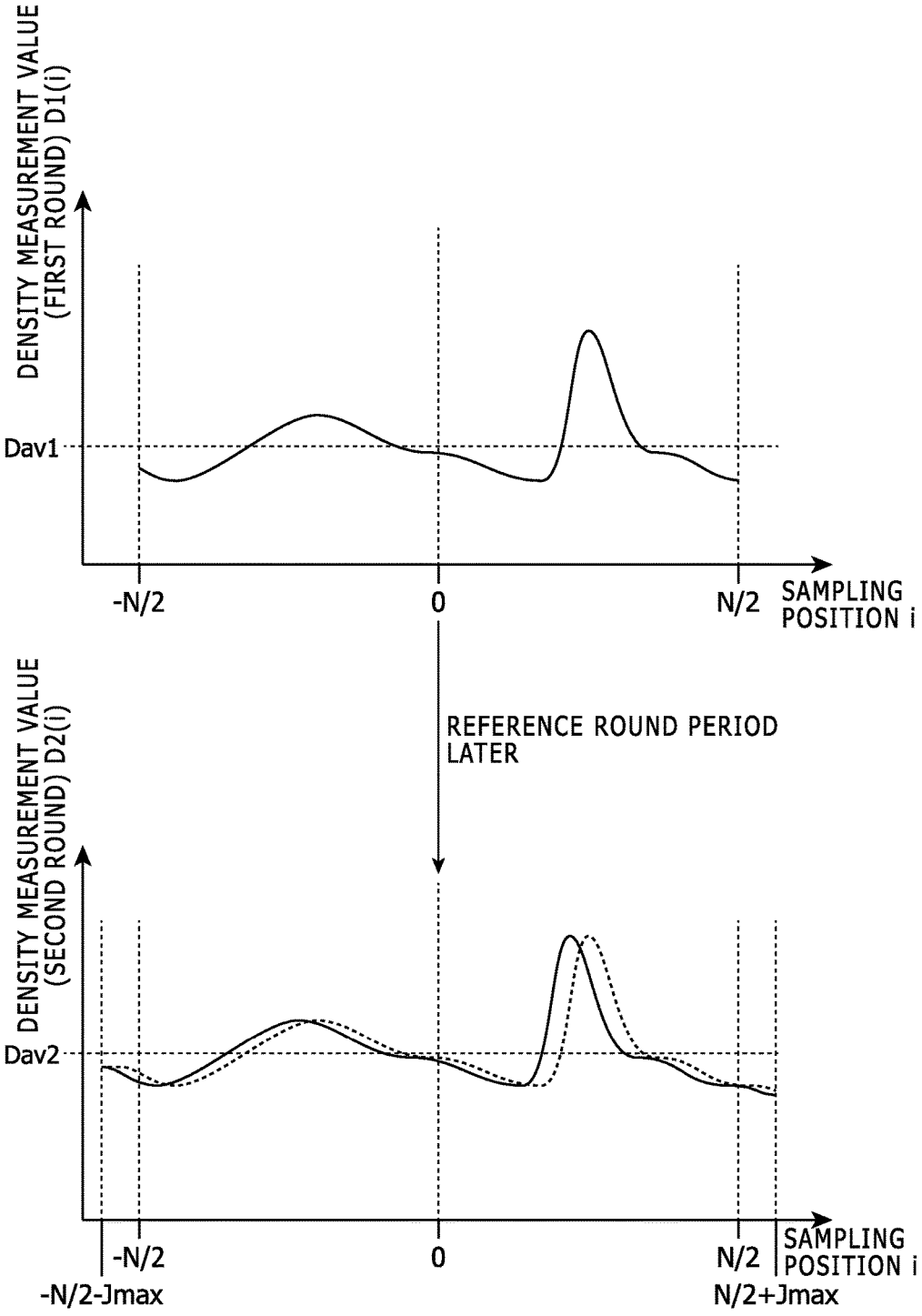
FIG. 5 shows a diagram that explains density measurement values at the first round and the second round.

FIG. 5 shows a diagram that explains density measurement values at the first round and the second round. As shown in FIG. 5, the average value D2*av* of the density measurement values D2(*i*) in the aforementioned specific section is sometimes different from the average value D1*av* of the density measurement values D1(*i*) in the aforementioned measurement section due to some causes. Further, if the round length of the intermediate transfer belt 4 is not changed from the reference round length L, as shown by a dashed line in FIG. 5, after measurement time points of the density measurement values D1(*i*) at the first round by the reference rotation period, the density measurement values D2(*i*) at the second round is obtained as a wave form (of fluctuation component) substantially same as a wave form (of fluctuation component) of the density measurement values D1(*i*) at the first round. Contrarily, if the round length of the intermediate transfer belt 4 is changed from the reference round length L, as shown by a solid line in FIG. 5, after measurement time points of the density measurement values D1(*i*) at the first round by the reference rotation period, the density measurement values D2(*i*) at the second round is not obtained as a wave form (of fluctuation component) substantially same as a wave form (of fluctuation component) of the density measurement values D1(*i*) at the first round.

FIG. 6 shows a diagram that indicates calculation formulas of a cross-correlation function R1(*j*) and a correlation index R2(*j*).

Therefore, for example, the density correction unit 21 gradually changes from −Jmax to Jmax a displacement j of the aforementioned specific section within the aforementioned extended section, at each displacement, calculates a sum of products R1(*j*) between a sequence of the N differences Diff1(*i*) in the section background data at the first round and a sequence of the N differences Diff2(*i*) in the section background data at the second round, determines the displacement j (=dj) that causes the sum of products R1(*j*) to be largest, and determines the rotation period of the intermediate transfer belt 4 on the basis of the determined displacement dj. It should be noted that when the specific section is set on the center of the extended section, j=0.

This sum of products R1(*j*) is a cross-correlation function and as shown in FIG. 6. In FIG. 6, a sampling position i at centers of the measurement section and the specific section is set as 0, and thereby each sampling position is expressed.

Figure 7:
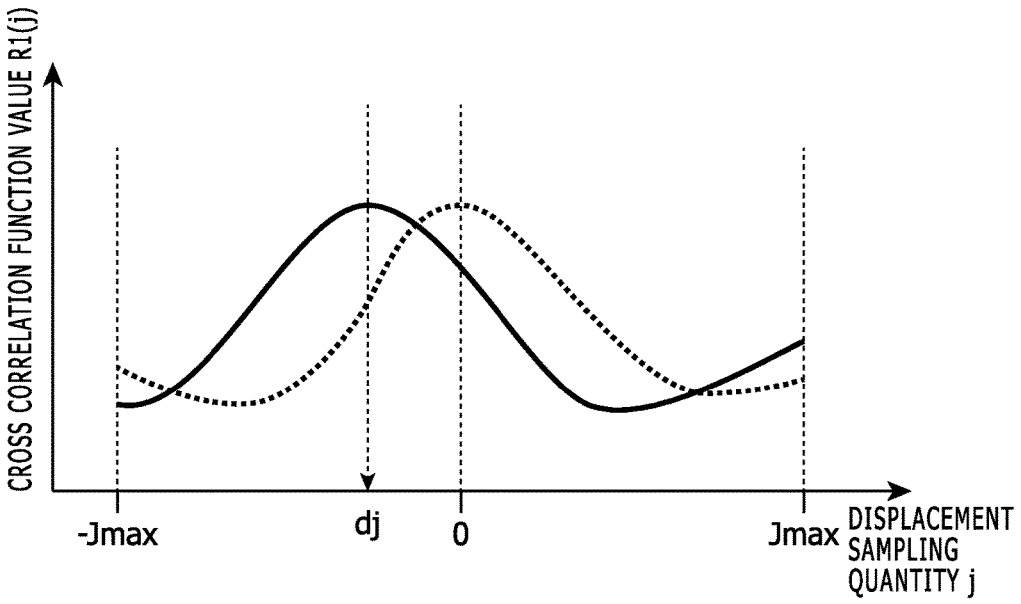
FIG. 7 shows a diagram that explains a value of the cross-correlation function R1(*j*)

FIG. 7 shows a diagram that explains a value of the cross-correlation function R1(*j*). As shown in FIG. 7, if the round length of the intermediate transfer belt 4 at a current time point is the reference round length L, the displacement dj at the largest of R1(*j*) gets 0 (in case of a dashed line in FIG. 7); and therefore as shown by a solid line in FIG. 7 the displacement dj at the largest of R1(*j*) obtained from the measurement values is determined and the rotation period of the intermediate transfer belt 4 at a current time point is determined from the reference round length L and the determined displacement dj.

Alternatively, for example, the density correction unit 21 gradually changes the displacement j from −Jmax to Jmax, at each displacement, calculates a sum R2(*j*) of respective second powers of differences between a sequence of the N differences Diff1(*i*) in the section background data at the first round and a sequence of the N differences Diff2(*i*+*j*) in the section background data at the second round, determines the displacement j (=dj) that causes the sum R2(*j*) to be largest, and determines the rotation period of the intermediate transfer belt 4 on the basis of the determined displacement dj.

This sum R2(*j*) is a correlation index and as shown in FIG. 6. In FIG. 6, a sampling position i at centers of the measurement section and the specific section is set as 0, and thereby each sampling position is expressed.

Figure 8:
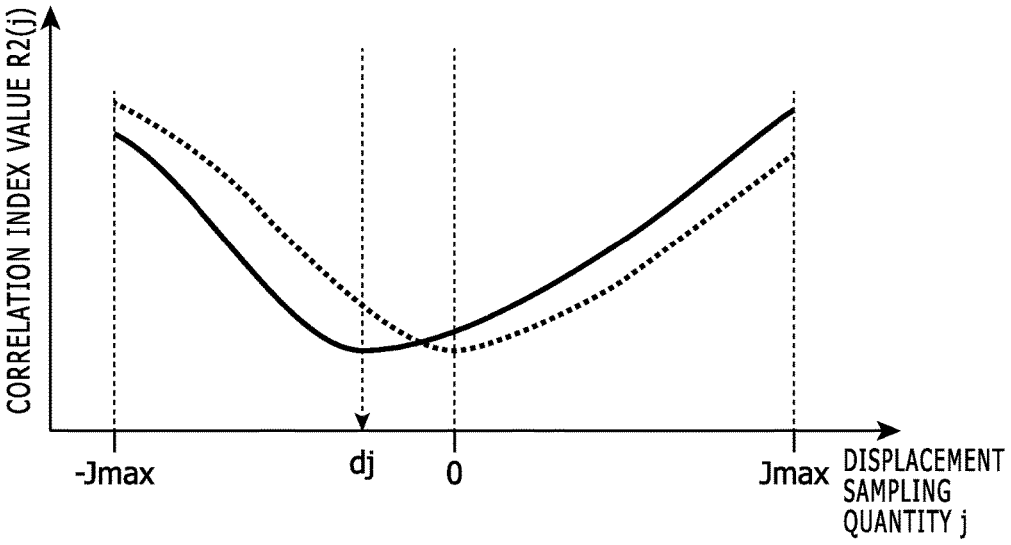
FIG. 8 shows a diagram that explains a value of the correlation index R2(*j*).

FIG. 8 shows a diagram that explains a value of the correlation index R2(*j*). As shown in FIG. 8, if the round length of the intermediate transfer belt 4 at a current time point is the reference round length L, the displacement dj at the smallest of R2(*j*) gets 0 (in case of a dashed line in FIG. 8); and therefore as shown by a solid line in FIG. 8 the displacement dj at the smallest of R2(*j*) obtained from the measurement values is determined and the rotation period of the intermediate transfer belt 4 at a current time point is determined from the reference round length L and the determined displacement dj.

Further, before performing correction of the aforementioned density characteristic (i.e. calibration), the density correction unit 21 determines whether the aforementioned measurement process should be performed or not. For example, the density correction unit 21 compares a current status of this image forming apparatus with a status of this image forming apparatus when the measurement process was performed at the previous time and thereby determines whether the measurement process should be performed or not. Specifically, on the basis of an elapsed time from the measurement process at the previous time to the current time point, the number of a consumed paper sheets from the measurement process at the previous time to the current time point, a temperature change from the measurement process at the previous time to the current time point, a humidity change from the measurement process at the previous time to the current time point, and/or the like, it is determined whether the aforementioned measurement process should be performed or not.

If it is determined that the aforementioned measurement process should be performed, the density correction unit 21 performs the aforementioned measurement process and thereafter performs the correction of the density characteristic on the basis of the rotation period obtained in the measurement process at this time as mentioned.

If it is determined that the measurement process should not be performed, the density correction unit 21 does not perform the measurement process at this time and performs the correction of the density characteristic on the basis of the rotation period obtained in the measurement process at the previous time as mentioned.

The following part explains a behavior of the aforementioned image forming apparatus.

When detecting a timing of the correction of the density characteristic (i.e. calibration), the density correction unit 21 determines whether the measurement process for measuring a rotation period of the intermediate transfer belt 4 should be performed or not.

If it is determined that the measurement process should be performed, then the density correction unit 21 performs the measurement process as mentioned below.

Firstly, at the first round of the intermediate transfer belt 4, the density correction unit 21 obtains density measurement values D1(*i*) (i=1, N) of a surface in a measurement section of the intermediate transfer belt 4, and this measurement section is a part in a circulating direction of the intermediate transfer belt 4. Here, N is the predetermined number of sampling times.

The density correction unit 21 calculates respective differences Diff1(*i*) between the density measurement values D1(*i*) and an average value D1*av* of the density measurement values D1(*i*) (Diff1(*i*)=D1(*i*)−D1*av*) as section background data at the first round, and keeps this section background data in a memory or the like.

Subsequently, at the second round of the intermediate transfer belt 4, the density correction unit 21 obtains density measurement values D2(*i*) of a surface in an extended section of the intermediate transfer belt 4, and temporarily keeps the density measurement values D2(*i*) in a memory or the like, and this extended section includes the measurement section.

Further, the density correction unit 21 gradually changes a displacement of a specific section and thereby determines section background data at the second round, and determines a rotation period of the intermediate transfer belt 4 on the basis of a correlation between the section background data at the first round and the section background data at the second round.

In this process, the density correction unit 21 gradually sets the displacement j from Jmax to −Jmax in order. For each displacement j, the density correction unit 21 determines the density measurement values D2(*i*) of the specific section corresponding to the current displacement j in the density measurement values D2(*i*) of the extended section, and calculates respective differences Diff2(*i*) between the density measurement values D2(*i*) of the specific section and an average value D2*av* of the density measurement values D2(*i*) of the specific section (Diff2(*i*)=D2(*i*)−D2*av*) as section background data at the second round, and keeps this section background data in a memory or the like. Here, when sampling positions are expressed so as to set the sampling position at centers of the measurement section and the specific section as 0, a sequence of D2(−N/2+j) to D2(N/2+j) is determined and selected as the density measurement values of the specific section in a sequence of the density measurement values D2 (−N/2−Jmax) to D2(N/2+Jmax) of the extended section.

Subsequently, for each displacement j, the density correction unit 21 calculates a correlation between the section background data at the first round and the section background data at the second round on the basis of the aforementioned cross-correlation function R1(*j*) or the aforementioned correlation index R2(*j*), and considers the displacement at the largest correlation (i.e. j when R1(*j*) is largest or j when R2(*j*) is smallest) as a difference from the reference round period and thereby determines a current round period of the intermediate transfer belt 4.

If the aforementioned measurement process is performed in this manner, then the density correction unit 21 performs the correction of the density characteristic on the basis of the rotation period obtained in the measurement process at this time as mentioned.

Contrarily, if the aforementioned measurement process is not performed, then the density correction unit 21 performs the correction of the density characteristic on the basis of the rotation period obtained in the measurement process at the previous time as mentioned.

In the aforementioned manner, the calibration is performed.

As mentioned, in this embodiment, the density correction unit 21 (a) performs a measurement process that measures a rotation period of the intermediate transfer belt 4, and (b) determines a density measurement value of a surface of the intermediate transfer belt 4 at a forming position of the toner pattern on the basis of the rotation period, determines a density of the toner pattern on the basis of the density measurement value of the toner pattern and the determined density measurement value of the surface of the intermediate transfer belt 4 and performs correction of a density characteristic on the basis of the determined density of the toner pattern. In this measurement process, the density correction unit 21 (a1) obtains density measurement values of a surface in a measurement section of the intermediate transfer belt 4 at the first round, (a2) calculates as section background data at the first round respective differences between the density measurement values at the first round and an average value of the density measurement values at the first round, (a3) obtains density measurement values of a surface at least in the measurement section of the intermediate transfer belt 4 at the second round, (a4) calculates as section background data at the second round respective differences between the density measurement values at the second round and an average value of the density measurement values at the second round in a specific section of which a length is identical to a length of the measurement section, and (a5) determines the rotation period on the basis of a correlation between the section background data at the first round and the section background data at the second round. Here the measurement section is a part in a circulating direction of the intermediate transfer belt 4.

Consequently, a surface density of the intermediate transfer belt 4 at a forming position of the toner pattern is correctly determined, and therefore, a density of the toner pattern on the intermediate transfer belt 4 is correctly determined.

It should be understood that various changes and modifications to the embodiments described herein will be apparent to those skilled in the art. Such changes and modifications may be made without departing from the spirit and scope of the present subject matter and without diminishing its intended advantages. It is therefore intended that such changes and modifications be covered by the appended claims.

For example, in the aforementioned embodiment, the intermediate transfer belt 4 is used as an image carrier of the toner pattern. Alternatively, a photoconductor drum may be used as such image carrier. In such a case, in the calibration, a density of the toner pattern formed on the photoconductor drum is measured.

Further, in the aforementioned embodiment, the second round is a round immediately after the first round, but the second round may be not a round immediately after the first round. For example, the second round may be a next round to a next round to the first round.

Furthermore, in the aforementioned embodiment, an area of the surface of the intermediate transfer belt 4 used for measurement of the density measurement value is set, for example, within an area out of an image area where a user toner image based on a user's image data is formed in image printing (i.e. an area between a user toner image and a subsequent user toner image in the secondary scanning direction).

What is claimed is:

1. An image forming apparatus, comprising:

an image carrier;

a density sensor configured to detect a density measurement value of a toner pattern on the image carrier and a density measurement value of a surface of the image carrier; and a density correction unit configured to (a) perform a measurement process that measures a rotation period of the image carrier, and (b) determine a density measurement value of a surface of the image carrier at a forming position of the toner pattern on the basis of the rotation period, determine a density of the toner pattern on the basis of the density measurement value of the toner pattern and the determined density measurement value of the surface of the image carrier, and perform correction of a density characteristic on the basis of the determined density of the toner pattern;

wherein in the measurement process, the density correction unit (a1) obtains density measurement values of a surface in a measurement section of the image carrier at a first round, (a2) calculates as section background data at the first round respective differences between the density measurement values at the first round and an average value of the density measurement values at the first round, (a3) obtains density measurement values of a surface at least in the measurement section of the image carrier at a second round, (a4) calculates as section background data at the second round respective differences between the density measurement values at the second round and an average value of the density measurement values at the second round in a specific section of which a length is identical to a length of the measurement section, and (a5) determines the rotation period on the basis of a correlation between the section background data at the first round and the section background data at the second round; and the measurement section is a part in a circulating direction of the image carrier.

2. The image forming apparatus according to claim 1, wherein the density correction unit obtains density measurement values of a surface of the image carrier at the second round in an extended section obtained by extending the measurement section by a predetermined length, calculates as the section background data at the second round respective differences between the density measurement values in the specific section within the extended section at the second round and an average value of the density measurement values in the specific section within the extended section at the second round; and the density correction unit gradually changes a displacement of the specific section within the extended section, at each displacement, calculates a sum of products between a sequence of the differences in the section background data at the first round and a sequence of the differences in the section background data at the second round, determines the displacement that causes the sum of products to be largest, and determines the rotation period of the image carrier on the basis of the determined displacement.

3. The image forming apparatus according to claim 1, wherein the density correction unit obtains density measurement values of a surface of the image carrier at the second round in an extended section obtained by extending the measurement section by a predetermined length, and calculates as the section background data at the second round respective differences between the density measurement values in the specific section within the extended section at the second round and an average value of the density measurement values in the specific section within the extended section at the second round; and the density correction unit gradually changes a displacement of the specific section within the extended section, at each displacement, calculates a sum of respective second powers of differences between a sequence of the differences in the section background data at the first round and a sequence of the differences in the section background data at the second round, determines the displacement that causes the sum of products to be smallest, and determines the rotation period of the image carrier on the basis of the determined displacement.

4. The image forming apparatus according to claim 1, wherein the density correction unit determines whether the measurement process should be performed or not before the correction of the density characteristic;

if it is determined that the measurement process should be performed, the density correction unit performs the measurement process at this time and determines a density measurement value of a surface of the image carrier at a forming position of the toner pattern on the basis of the rotation period obtained in the measurement process performed at this time, determines a density of the toner pattern on the basis of the density measurement value of the toner pattern and the determined density measurement value of the surface of the image carrier, and performs correction of a density characteristic on the basis of the determined density of the toner pattern;

if it is determined that the measurement process should not be performed, the density correction unit does not perform the measurement process at this time and determines a density measurement value of a surface of the image carrier at a forming position of the toner pattern on the basis of the rotation period obtained in the measurement process performed at a previous time, determines a density of the toner pattern on the basis of the density measurement value of the toner pattern and the determined density measurement value of the surface of the image carrier, and performs correction of a density characteristic on the basis of the determined density of the toner pattern.

5. The image forming apparatus according to claim 4, wherein the density correction unit compares a current status of the image forming apparatus with a status of the image forming apparatus when the measurement process was performed at the previous time and thereby determines whether the measurement process should be performed or not.

6. The image forming apparatus according to claim 1, wherein an area of the surface of the image carrier used for measurement of the density measurement value is set within an area out of an image area where a user toner image based on a user's image data is formed in image printing.

* * * * *